US009234378B2

(12) United States Patent
Hansen

(10) Patent No.: US 9,234,378 B2
(45) Date of Patent: Jan. 12, 2016

(54) POWER TAILGATE SYSTEM

(71) Applicant: Strattec Power Access LLC, Troy, MI (US)

(72) Inventor: Eric R. Hansen, Lake Orion, MI (US)

(73) Assignee: STRATTEC POWER ACCESS LLC, Troy, MI (US)

( * ) Notice: Subject to any disclaimer, the term of this patent is extended or adjusted under 35 U.S.C. 154(b) by 0 days.

(21) Appl. No.: 14/266,329

(22) Filed: Apr. 30, 2014

(65) Prior Publication Data

US 2014/0324251 A1 Oct. 30, 2014

Related U.S. Application Data

(60) Provisional application No. 61/817,723, filed on Apr. 30, 2013.

(51) Int. Cl.
*E05F 15/00* (2015.01)
*E05F 15/63* (2015.01)

(52) U.S. Cl.
CPC ..... *E05F 15/63* (2015.01); *E05Y 2201/696* (2013.01); *E05Y 2600/626* (2013.01); *E05Y 2900/546* (2013.01)

(58) Field of Classification Search
CPC ..... B60P 1/26; B62D 33/027; B62D 33/03; B62D 33/033; B62D 33/037; E05F 15/10; E05F 15/12; E05F 15/121; E05F 15/63; E05Y 2201/696; E05Y 2600/626; E05Y 2900/546
USPC ..... 701/2, 36, 45, 49; 296/50, 51, 52, 53, 296/55, 56, 57.1, 59
See application file for complete search history.

(56) References Cited

U.S. PATENT DOCUMENTS

| | | | | |
|---|---|---|---|---|
| 5,358,301 | A * | 10/1994 | Konchan et al. | 296/146.1 |
| 5,449,212 | A * | 9/1995 | Seifert | 296/57.1 |
| 5,982,126 | A | 11/1999 | Hellinga et al. | |
| 6,030,019 | A * | 2/2000 | Stiltner et al. | 296/57.1 |
| 6,183,039 | B1 | 2/2001 | Kohut et al. | |
| 6,217,097 | B1 | 4/2001 | Rogers, Jr. et al. | |
| 6,367,199 | B2 | 4/2002 | Sedlak et al. | |
| 6,367,864 | B2 | 4/2002 | Rogers, Jr. et al. | |
| 6,454,339 | B2 | 9/2002 | Wilde et al. | |
| 6,520,557 | B2 | 2/2003 | Benthaus et al. | |
| 6,539,670 | B2 | 4/2003 | Haag et al. | |
| 6,550,838 | B2 * | 4/2003 | Bobbitt et al. | 296/52 |
| 6,719,354 | B2 | 4/2004 | Holt | |
| 6,773,047 | B2 | 8/2004 | Gruber | |
| 6,923,488 | B2 | 8/2005 | Bruford et al. | |
| 6,966,595 | B2 | 11/2005 | Bruford et al. | |
| 6,983,972 | B2 | 1/2006 | Tan et al. | |
| 7,025,298 | B2 | 4/2006 | Priest et al. | |
| 7,070,222 | B2 | 7/2006 | Bruford et al. | |
| 7,090,276 | B1 | 8/2006 | Bruford et al. | |
| 7,484,784 | B2 * | 2/2009 | Ohly | 296/57.1 |
| 7,503,619 | B2 * | 3/2009 | Werner | 296/146.8 |
| 7,530,619 | B1 | 5/2009 | Bruford et al. | |

(Continued)

*Primary Examiner* — Jerrah Edwards
*Assistant Examiner* — Tamara Weber
(74) *Attorney, Agent, or Firm* — Michael Best & Friedrich LLP

(57) ABSTRACT

A power tailgate system for a vehicle includes an actuator for moving a tailgate of the vehicle between an open position and a closed position. The power tailgate system also includes a spring spaced apart from the actuator for counter-balancing a weight of the tailgate and a coupler assembly for removably coupling the tailgate to the power tailgate system.

19 Claims, 10 Drawing Sheets

(56) References Cited

U.S. PATENT DOCUMENTS

| | | | | |
|---|---|---|---|---|
| 7,690,711 | B2 * | 4/2010 | McGowan et al. | 296/57.1 |
| 8,141,929 | B2 * | 3/2012 | Marshall | 296/51 |
| 8,348,331 | B2 | 1/2013 | Holt | |
| 8,366,129 | B2 | 2/2013 | Salmon et al. | |
| 2004/0032141 | A1 * | 2/2004 | Moyna | 296/50 |
| 2008/0252092 | A1 * | 10/2008 | Waldner et al. | 296/51 |
| 2008/0252094 | A1 * | 10/2008 | Schulte et al. | 296/57.1 |
| 2012/0326464 | A1 * | 12/2012 | Kileen | 296/56 |
| 2013/0278004 | A1 * | 10/2013 | Sackett | 296/57.1 |

* cited by examiner

POWER TAILGATE SYSTEM

CROSS-REFERENCE TO RELATED APPLICATIONS

This application claims priority to U.S. Provisional Patent Application No. 61/817,723, filed Apr. 30, 2013, the entire content of which is incorporated herein by reference.

FIELD OF THE INVENTION

The present invention relates to an automotive power partition, and more particularly to a power tailgate system for use in a pick-up truck.

BACKGROUND OF THE INVENTION

Pick-up trucks commonly have a tailgate, which can be opened or closed by a user to access a box or bed of the pick-up truck. Such tailgates are manually operable and often can be heavy or difficult to safely open and close when the user is holding one or more objects. Some tailgates are removable to provide additional functionality to the truck in accordance with the user's needs. Removal of the tailgate from the truck, however, can be cumbersome and time consuming because one or more tools are required by the user to facilitate removal of the tailgate from the truck.

SUMMARY OF THE INVENTION

The present invention provides, in one aspect, a power tailgate system for a vehicle. The power tailgate system includes an actuator for moving a tailgate of the vehicle between an open position and a closed position, and a spring spaced apart from the actuator for counter-balancing a weight of the tailgate. The power tailgate system also includes a coupler assembly movable relative to the tailgate between a locked position and an unlocked position. In the locked position, the actuator is secured to the tailgate. In the unlocked position, the tailgate is removable from the vehicle and the actuator.

The power tailgate system may further include an actuator arm assembly having a pin defining an axis of rotation and an arm having a first end rotatable about the pin. The actuator may be configured to rotate the first end of the arm about the pin, thereby moving the tailgate of the vehicle between the open position and the closed position.

The actuator may have a proximal end fitting attached to the vehicle and a distal end fitting coupled to a second end of the arm of the actuator arm assembly. The second end of the arm of the actuator arm assembly may pivot towards the proximal end fitting of the actuator when the tailgate moves to the open position. The second end of the arm of the actuator arm assembly may pivot away from the proximal end fitting of the actuator when the tailgate moves to the closed position.

The coupler assembly may include a body fixed to the tailgate and having a slot for receiving the pin of the actuator arm assembly.

The coupler assembly may include a collar slidable between a first position and a second position and in a direction parallel to the rotational axis defined by the pin of the actuator arm assembly. The collar may have a slot. The coupler assembly may further include a lever engagable with the slot of the collar. In the first position, the lever may engage the slot of the collar, thereby permitting removal of the tailgate from the vehicle.

The first end of the arm may include teeth. The teeth may be engagable with notches of the collar when the collar is in the second position, thereby preventing removal of the tailgate from the vehicle.

The power tailgate system may further include an electronic controller in electrical communication with the actuator and configured to receive a signal for opening the tailgate or a signal for closing the tailgate. The electronic controller may receive the signals for opening and closing the tailgate from a fob. The electronic controller may be configured to detect if the tailgate is coupled to the power tailgate system.

The present invention provides, in another aspect, a coupler assembly for removably attaching a tailgate to a vehicle. The coupler assembly includes a body fixed to the tailgate and having a slot for receiving a portion of the vehicle. The coupler assembly also includes a collar positioned about the body. The collar is movable between a first position permitting removal of the tailgate from the vehicle and a second position preventing removal of the tailgate from the vehicle.

The coupler assembly may further include a lever. The collar may include a slot engagable with the lever when the collar is located in the first position.

The lever may be movable, thereby allowing the collar to move between the first position and the second position. The lever may be movable by a spring.

The slot of the body may receive the portion of the vehicle when the collar is located in the second position. The collar may include notches for receiving a second portion of the vehicle when the collar is located in the second position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
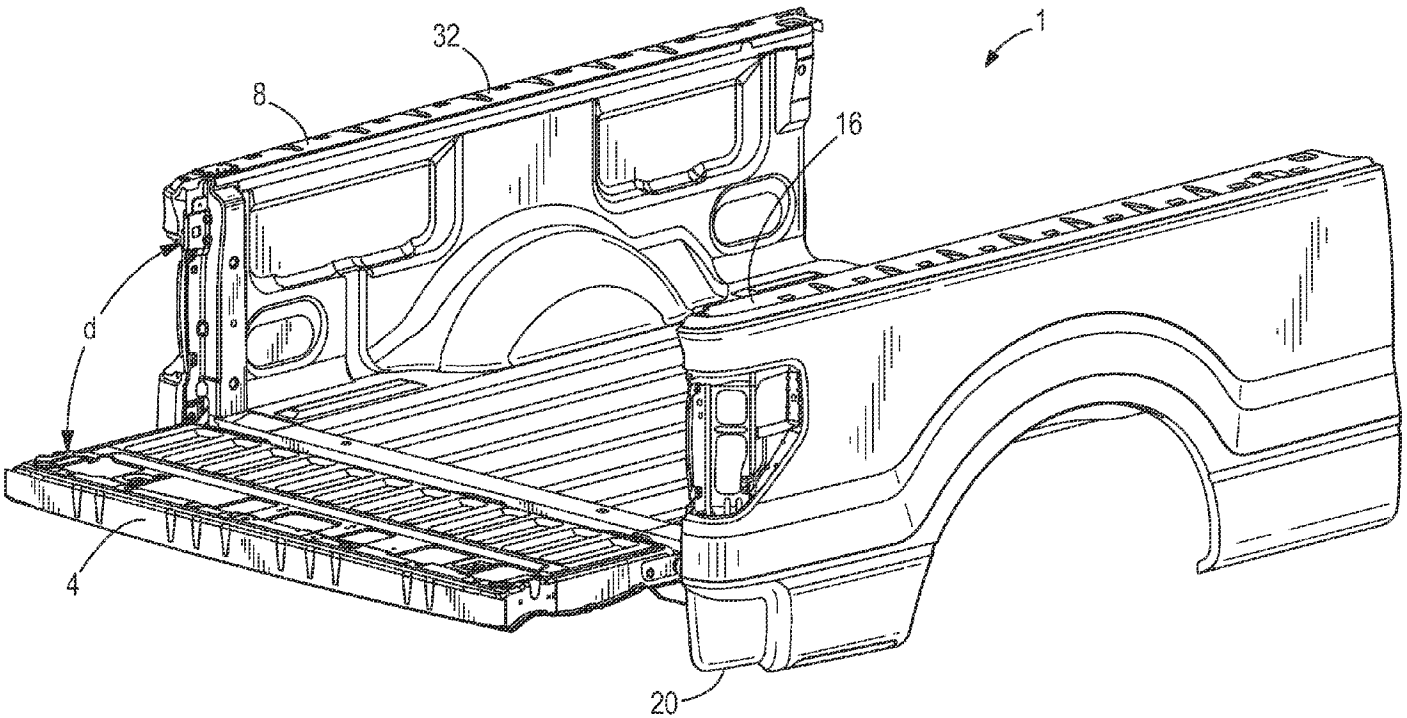
FIG. 1 is a perspective view of a rear portion of a vehicle including a power tailgate system.
Figure 3:
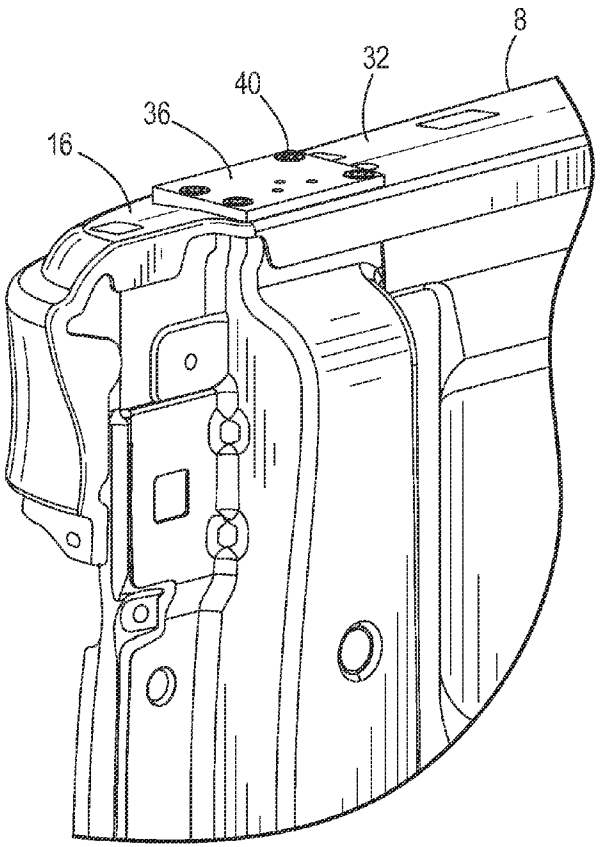
FIG. 3 is another partial perspective view of the strut of FIG. 2.
Figure 2:
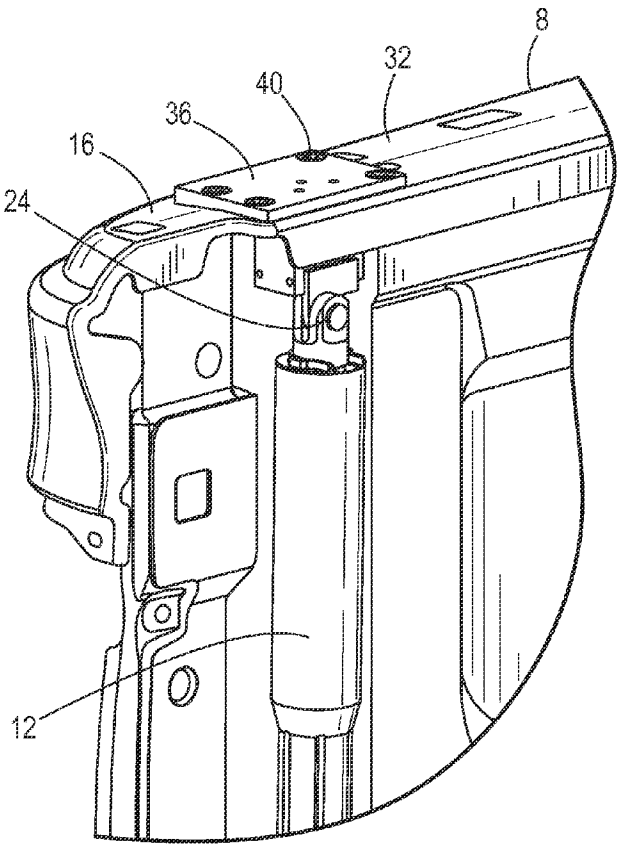
FIG. 2 is a partial perspective view of a strut of the power tailgate system of FIG. 1.

FIG. 1 illustrates a power tailgate system installed or located in a vehicle 1 having a tailgate 4, for example, a pick-up truck. The power tailgate system is positioned in a rear portion or box 8 of the vehicle 1 and moves the tailgate 4 between an open position and a closed position (e.g., through an included angle "d"). The power tailgate system includes an actuator 12 (e.g., a power strut) extending between top and bottom sides 16, 20 of the box 8 of the truck 1 and contained within the box 8 of the truck 1 (FIGS. 2 and 3). The power tailgate system may include a single strut 12 for moving the tailgate 4 between the open position and the closed position. In alternative embodiments, the power tailgate system may include two struts 12 positioned opposite of one another (e.g., located on opposite sides of the tailgate 4 or box 8 of the truck 1) for moving the tailgate 4 between the open position and the closed position.

Figure 5:
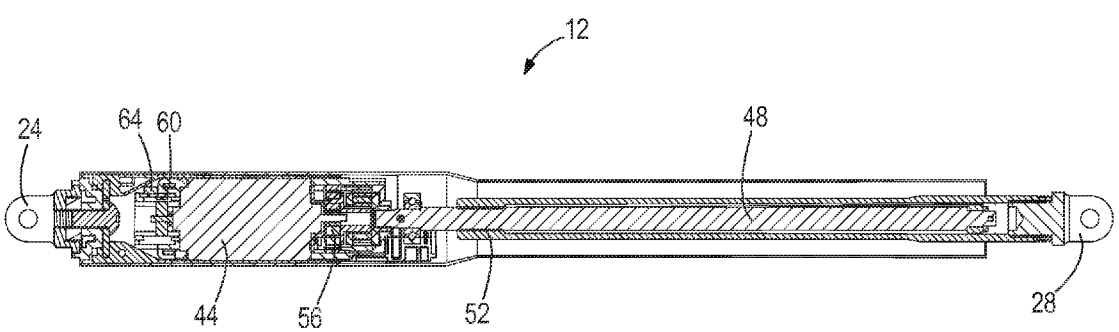
FIG. 5 is a cross-sectional view of the strut of FIG. 4.
Figure 4:
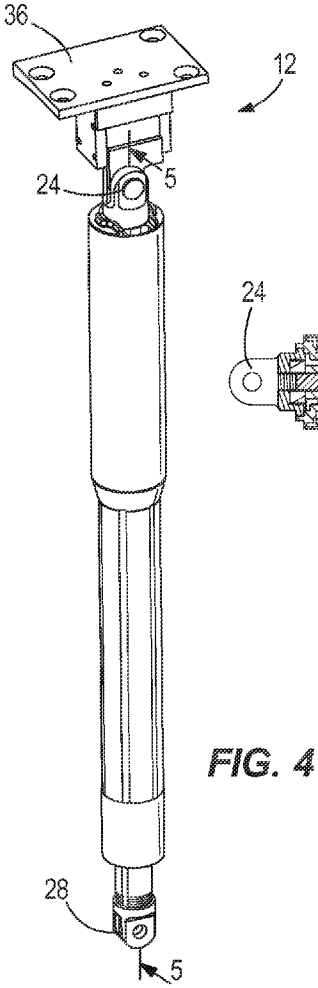
FIG. 4 is a perspective view of the strut of FIG. 2.

In the illustrated construction, the strut 12 has clevis endfittings 24, 28, in which the endfitting 24 proximal to the top side 16 of the box 8 is fastened or attached to the vehicle 1. In particular, the proximal endfitting 24 is fastened or attached to a rail 32 of the box 8 via a plate 36 of the strut 12 and fasteners 40 (FIGS. 2-5). The fasteners 40 can be, but are not limited to, bolts, screws, nuts, and combinations thereof. The strut 12 houses or contains a motor 44 for rotating or turning a linear screw or jackscrew 48 relative to a nut 52, thereby linearly moving or actuating the strut 12 (FIG. 5). The strut 12 also includes a planetary gearbox or gear train 56 positioned between the motor 44 and jackscrew 48, and a sensor 60 and a magnet 64. In some embodiments, the sensor 60 can be a Hall effect sensor used for, but not limited to, speed control, direction of motion, and obstacle detection.

With continued reference to FIG. 5, the strut 12 does not contain or house a spring, and therefore, the strut 12 does not counter-balance a weight of the tailgate 4. Rather the spring is spaced apart from the strut 12 or located external of the strut 12. In some embodiments, the spring can be integral to the truck 1, for example, the spring can be located within or positioned adjacent the tailgate 4. In other embodiments, the spring can surround a torque rod running a length dimension of the tailgate 4, thereby counter-balancing the weight of the tailgate 4 when a user opens and closes the tailgate 4. Accordingly, the strut 12 powers or drives the tailgate 4 between the open and closed positions while the spring counter-balances the weight of the tailgate 4 when the tailgate 4 is powered or driven by the strut 12.

Figure 7:
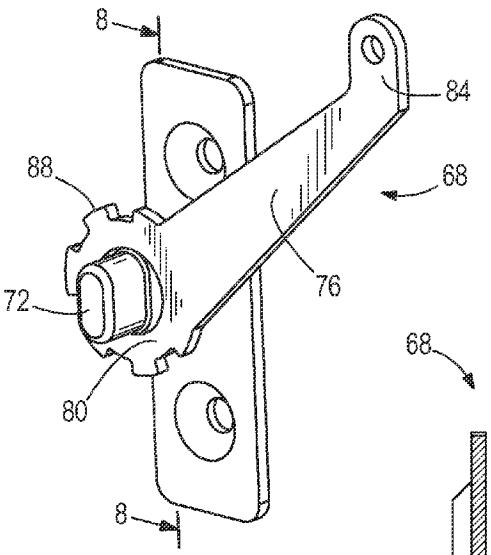
FIG. 7 is a perspective view of the actuator arm assembly of the power tailgate system of FIG. 1.
Figure 8:
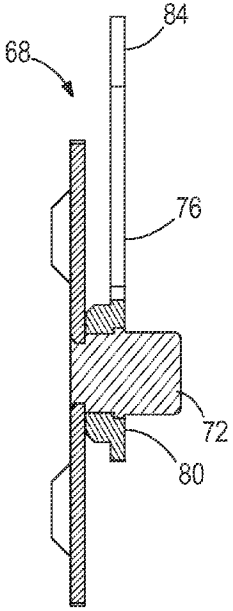
FIG. 8 is a cross-sectional view of the actuator arm assembly of FIG. 7.
Figure 6:
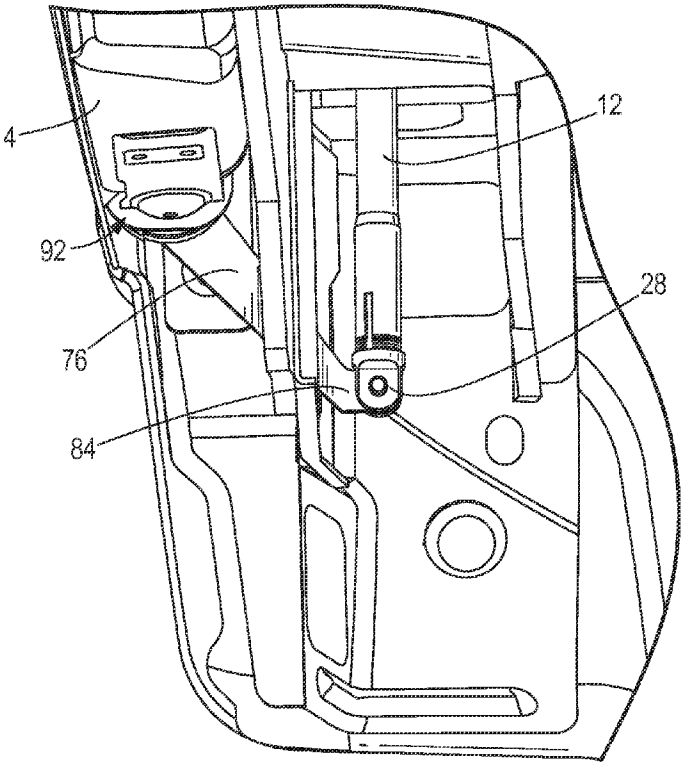
FIG. 6 is a perspective view of the power tailgate system of FIG. 1, illustrating the strut and an actuator arm assembly of the power tailgate system.
Figure 9:
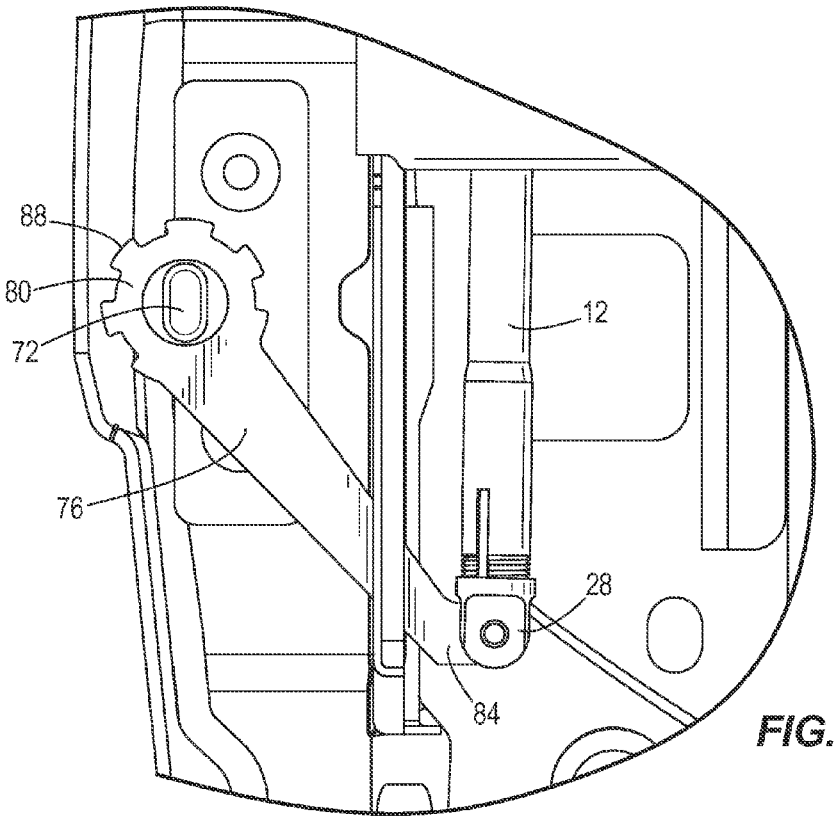
FIG. 9 is an enlarged view of the power tailgate system of FIG. 1, illustrating the strut and actuator arm assembly of the power tailgate system.

As illustrated in FIGS. 6-9, the power tailgate system also includes an actuator arm assembly 68 positioned between the strut 12 and the tailgate 4. The actuator arm assembly 68 includes a stationary pin 72 attached to the truck 1 and defining an axis of rotation. An actuator or drive arm 76 is pivotably or rotatably coupled to the stationary pin 72 (FIG. 7). Particularly, a first end 80 of the drive arm 76 is pivotable, rotatable, or movable about the stationary pin 72 and therefore, the rotational axis (FIG. 8), while a second end 84 of the drive arm 76 is coupled or attached to the distal endfitting 28 of the strut 12 (FIGS. 6 and 9). Accordingly, the strut 12 is configured to rotate the first end of the drive arm 76 about the stationary pin 72 (via the attachment to the second end 84 of the drive arm 76), thereby moving the tailgate 4 of the vehicle 1 between the open position and the closed position.

Additionally, the first end 80 of the drive arm 76 includes teeth 88 engageable with a coupler assembly 92 of the power tailgate system (FIGS. 7 and 9). The coupler assembly 92 may facilitate or allow for removably coupling or securing the tailgate 4 to the vehicle 1 and the power tailgate system. The coupler assembly 92 may be movable relative to the tailgate 4 between a locked position and an unlocked position. In the locked position, the strut 12 may be secured or attached to the tailgate 4 while in the unlocked position, the tailgate 4 may be removable from the vehicle 1 and the strut 12. In some embodiments, the coupler assembly 92 can allow for quick disconnection or connection of the tailgate 4 to the box 8 of the truck 1 as described below in more detail.

In some embodiments, a single coupler assembly 92 may be used for the quick disconnection or connection of the tailgate 4 to the box 8 of the truck 1. Such a single coupler assembly 92, when in the locked position, may be coupled or secured to the strut 12 via the actuator arm assembly 68 as described below in more detail. If a single coupler assembly 92 is used, then the vehicle 1 may include a slot for receiving a pin fixed or attached to the tailgate 4. Alternatively, the vehicle 1 may include the pin and the tailgate 4 may include the slot. This combination of the slot and pin may be located or positioned opposite of the coupler assembly 92 (i.e., such that the coupler assembly 92 and the combination of the slot and pin are located or positioned on opposite sides or ends of the tailgate 4). In still other alternative embodiments, another form of mechanically coupling or securing the tailgate 4 and the vehicle 1 may be used in place of the combination of the pin and slot.

In other embodiments, two coupler assemblies 92 may be used for the quick disconnection or connection of the tailgate 4 to the box 8 of the truck 1. The two coupler assemblies 92 may be located opposite one another, for example, on opposite sides of the box 8 of the truck 1 or on opposite ends or sides of the tailgate 4. The two coupler assemblies 92, when in the locked position, may be coupled or secured to respective struts 12 (via respective actuator arm assemblies 68) if the power tailgate system includes two struts 12. Alternatively, if the power tailgate system includes a single strut 12, one coupler assembly 92, when in the locked position, may be coupled or secured to the strut 12 while the other coupler assembly 92, when in the locked position, may be coupled or secured to a portion of the vehicle.

Figure 10:
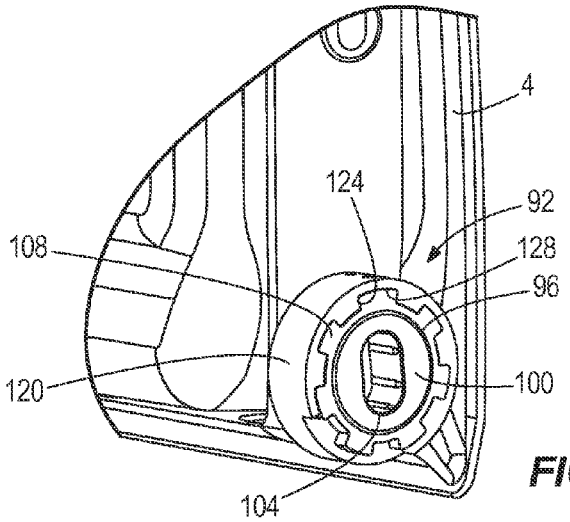
FIG. 10 is a perspective view of a coupler assembly of the power tailgate system of FIG. 1.
Figure 12:
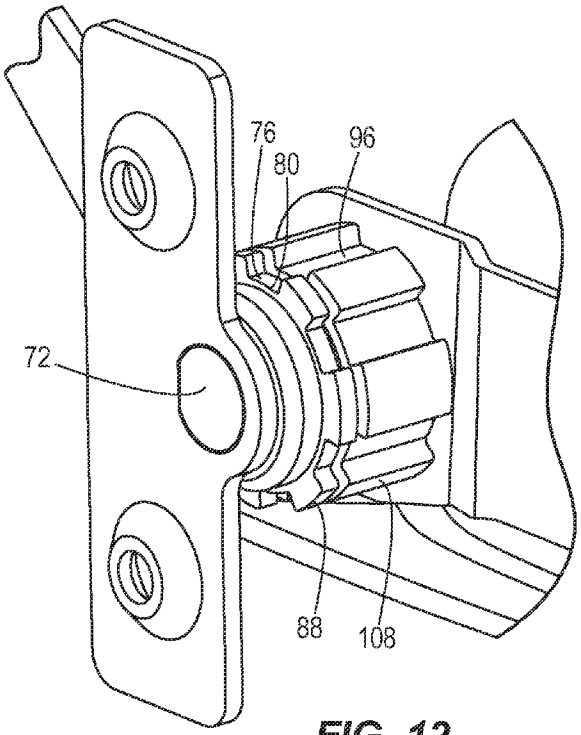
FIG. 12 is a partial perspective view of the power tailgate system of FIG. 1, illustrating a matching arrangement of teeth of the actuator arm assembly and the coupler assembly.
Figure 11:
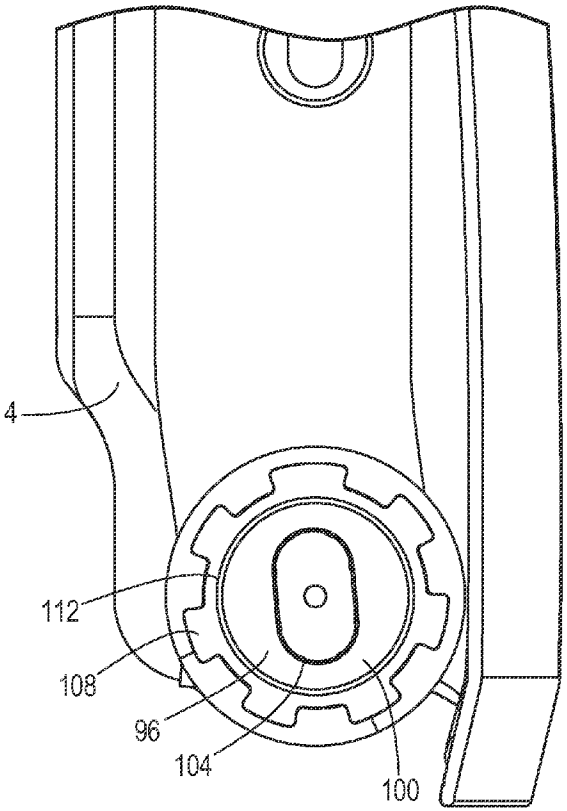
FIG. 11 is a partial view of the coupler assembly of the power tailgate system of FIG. 1.
Figure 14:
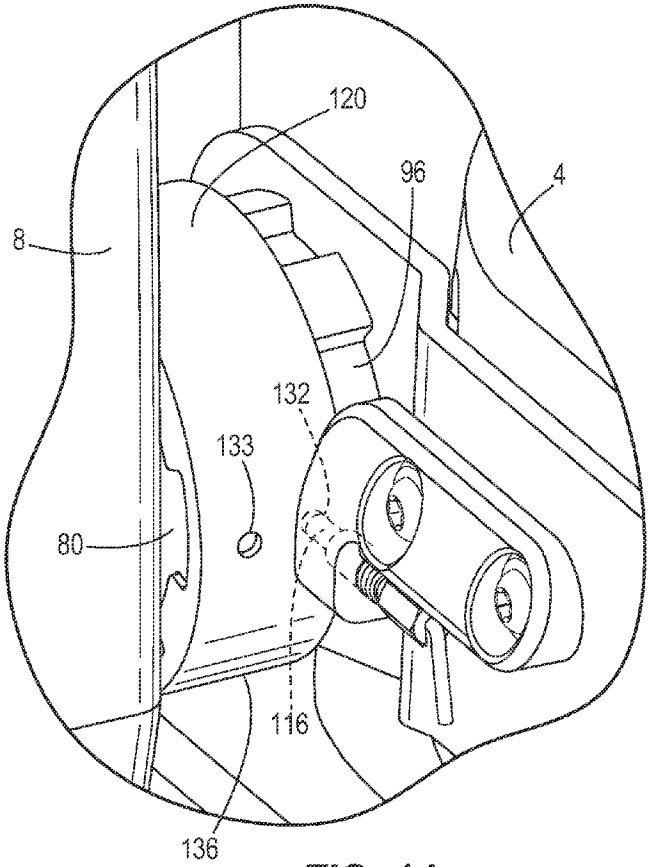
FIG. 14 is another perspective view of the power tailgate system of FIG. 1, showing the collar of the coupler assembly in a position that prevents removal of the tailgate from the vehicle.
Figure 13:
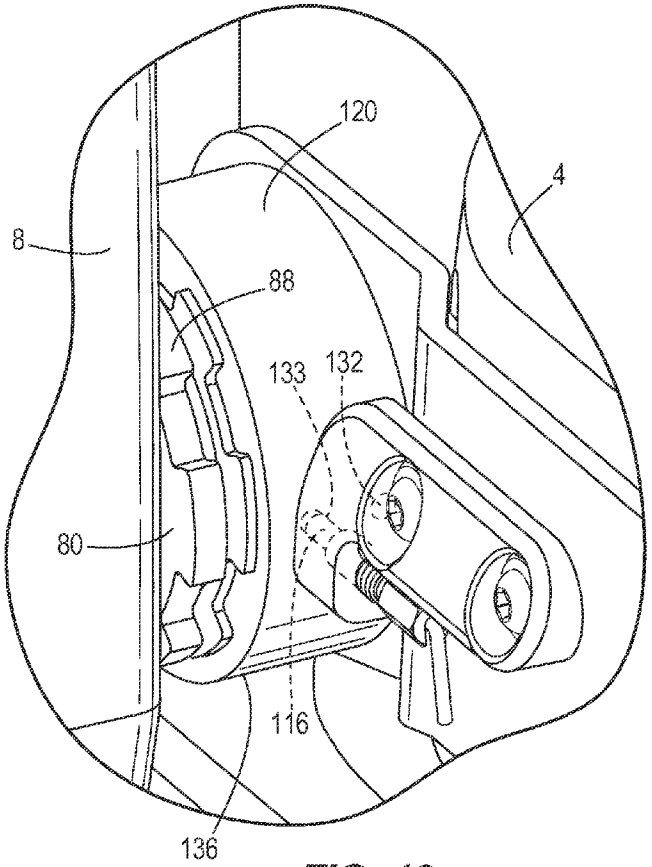
FIG. 13 is a perspective view of the power tailgate system of FIG. 1, showing a collar of the coupler assembly in a position that allows removal of the tailgate from the vehicle.

With reference to FIGS. 10 and 11, the coupler assembly 92 includes a body or cylinder 96 having a first surface welded or fixed to the tailgate 4, and a second surface 100 opposite the first surface and containing a slot 104 for receiving the stationary pin 72. Teeth 108 are located about a circumference 112 of the cylinder 96 and positioned adjacent the teeth 88 of the drive arm 76 when the stationary pin 72 is received by the slot 104 in the cylinder 96 (FIG. 12). The coupler assembly 92 also includes a lever 116 that extends in a direction transverse to the rotational axis defined by the stationary pin 72 (FIGS. 13 and 14). In some embodiments, the lever 116 is coupled or fixed to the tailgate 4.

The coupler assembly 92 also includes a collar 120 positioned about or encircling the cylinder 96, and having notches 124 located on an interior surface 128 thereof for receiving the teeth 88, 108 of the cylinder 96 and drive arm 76. The collar 120 is slidable or movable in a direction parallel to the rotational axis defined by the stationary pin 72. In other words, the collar 120 is slidable or movable between the tailgate 4 and the actuator arm assembly 68.

Figure 15:
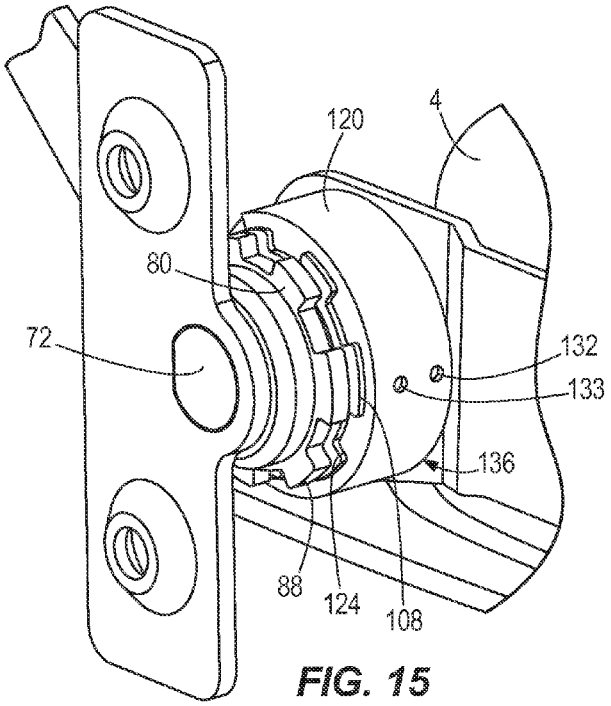
FIG. 15 is a partial perspective view of the power tailgate system of FIG. 1, illustrating the collar of the coupler assembly in the position that allows removal of the tailgate from the vehicle.
Figure 16:
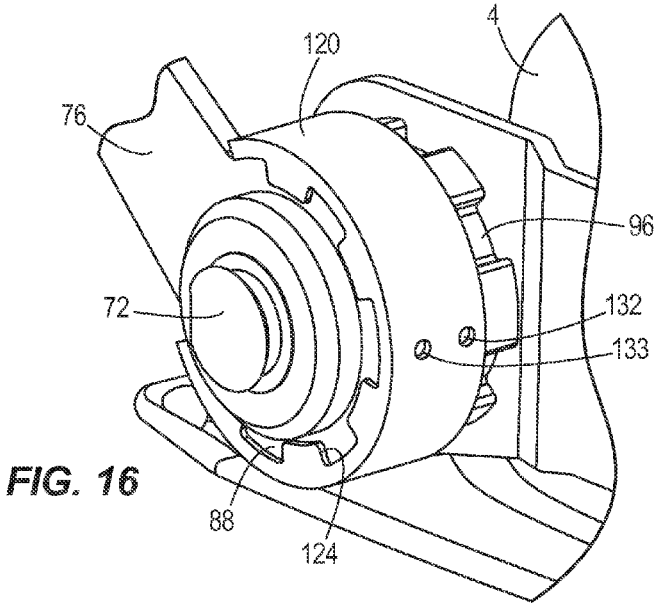
FIG. 16 is another partial perspective view of the power tailgate system of FIG. 1, illustrating the collar of the coupler assembly in the position that prevents removal of the tailgate from the vehicle.
Figure 17:
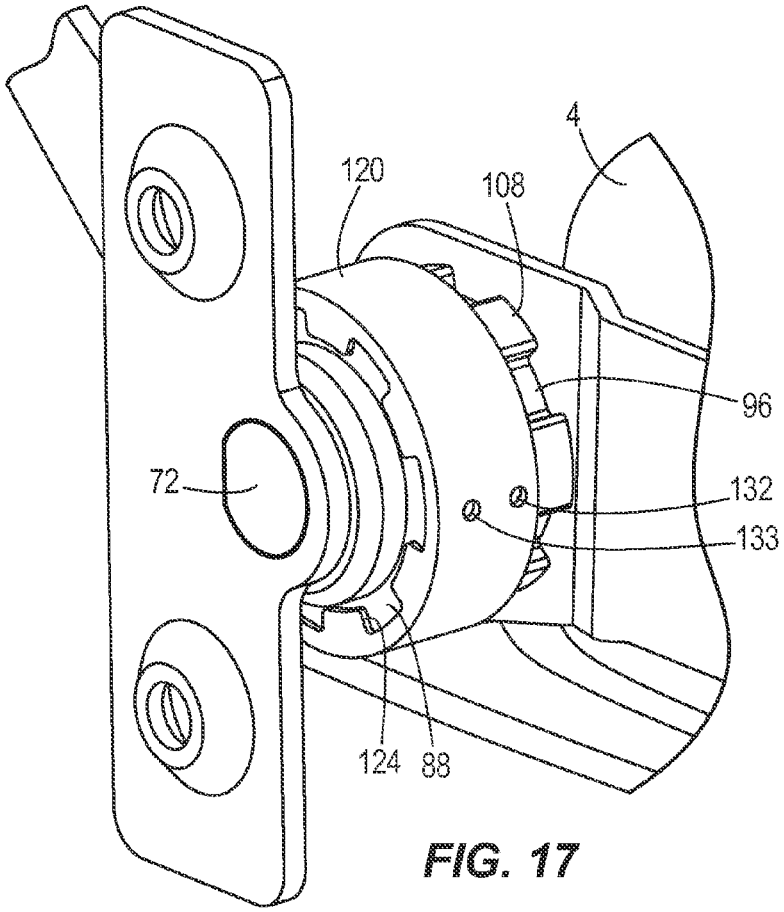
FIG. 17 is a partial perspective view of the power tailgate system of FIG. 1, illustrating the collar of the coupler assembly in the position that prevents removal of the tailgate from the vehicle.

The collar 120 has slots 132, 133 on an exterior surface 136 thereof engagable with the lever 116 (FIGS. 13 and 14). The slot 132 is located proximal to the tailgate 4 while the slot 133 is located distal to the tailgate 4. When the distal slot 133 in the collar 120 and the lever 116 are engaged, the collar 120 is locked or fixed in a first position (i.e., the above-described unlocked position of the coupler assembly 92), allowing or permitting removal of the stationary pin 72 from the slot 104 in the cylinder 96, and therefore, removal of the tailgate 4 from the box 8 of the truck 1 (i.e., uncoupling of the tailgate 4 from the power tailgate system) (FIGS. 13 and 15). When the lever 116 is removed from the distal slot 133, the collar 120 can be slide towards the drive arm 76 and engage the teeth 88, 108 of both the drive arm 76 and the cylinder 96. The collar 120 is prevented from sliding back towards the tailgate 4 by the lever 116 because the lever 116 now engages the proximal slot 132 (FIGS. 14, 16, and 17). Accordingly, the collar 120 is locked or fixed in a second position (i.e., the above-described locked position of the coupler assembly 92), thereby preventing separation of the stationary pin 72 and the slot 104 in the cylinder 96 (FIGS. 14, 16, and 17). In such a second position, the tailgate 4 cannot be removed from the box 8 of the truck 1 and cannot be uncoupled from the power tailgate system. Upon removal of the lever 116 from the proximal slot 132, the collar 120 may be slid back towards the tailgate 4 (and away from the drive arm 76) and into the first position to permit removal of the tailgate 4 from the vehicle 1.

In an alternative embodiment, the collar 120 may include a single slot or notch and the lever 116 may extend from the cylinder 96 in the direction transverse to the rotational axis defined by the stationary pin 72. In this alternative embodiment, the slot of the collar 120 may engage the lever 116 when the collar 120 is in the first position (i.e., not engaging both teeth 88 and teeth 108), but upon removal of the lever 116 from the slot, the collar 120 may be slid to the second position and engage teeth 88, 108. In this alternative embodiment, the collar 120 is prevented from sliding back towards the tailgate 4 by the lever 116 extending from the cylinder 96 because the collar 120 abuts or backs into the lever 116.

In some embodiments of the coupler assembly 92, the lever 116 of the cylinder 96 can be actuated or moved by a spring such that applying a force against the spring bias allows the collar 120 to slide between the first position (i.e., the lever 116 is located within the distal slot 133 in the collar 120) and the second position (i.e., the lever 116 is located within the proximal slot 132 in the collar 120). In other embodiments, threads may replace the teeth 88, 108 on both the cylinder 96 and the drive arm 76 such that the collar 120 can be threaded or rotated between the first and second positions.

Figure 18:
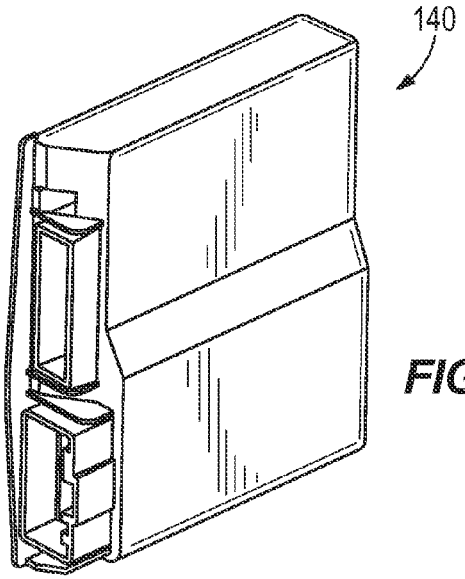
FIG. 18 is a perspective view of an electronic controller of the power tailgate system of FIG. 1.

With reference to FIG. 18, the power tailgate system further includes an electronic controller 140 located within the truck 1 and in electrical communication with the strut 12. In some embodiments, the electronic controller 140 can be located within a cab of the truck 1. Alternatively, the electronic controller 140 may be located in any number of locations within the truck 1, for example, a front or rear portion of the truck 1. The electronic controller 140 can be configured to receive a signal for moving the tailgate 4 to the open position or a signal for moving the tailgate 4 to the closed position. In particular, the electronic controller 140 can receive and implement or execute an open tailgate signal. The electronic controller 140 can also receive and implement or execute a close tailgate signal. Accordingly, when executing the open and close tailgate signals, the electronic controller 140 electrically communicates with the strut 12 to move the jackscrew 48 towards and away from the proximal endfitting 24, respectively, thereby powering or driving movement of the tailgate 4.

The electronic controller 140 can be operable with a fob (e.g., remote keyless entry), and therefore, the electronic controller 140 can verify an identity of the fob and execute instructions provided by the fob, for example, opening or closing the tailgate 4 of the truck 1. In other embodiments, the electronic controller 140 can be operable with a switch to facilitate opening and closing of the tailgate 4. In still other alternative embodiments, two or more electronic controllers may be in electrical communication with each other and/or the strut 12 to facilitate opening and closing of the tailgate 4.

In some embodiments, the electronic controller 140 can include a latching routine that powers unlatching of the tailgate 4 from the box 8 of the truck 1 before powering the tailgate 4 open. Conversely, the latching routine can power the tailgate 4 closed before powering latching of the tailgate 4 to the box 8 of the truck 1. In other embodiments, the electronic controller 140 can include a falling tailgate routine that controls descent and/or ascent of the tailgate 4 when the tailgate 4 is powered open and closed, respectively. The falling tailgate routine can also control or cushion descent of the tailgate 4 when the tailgate 4 is manually opened by the user, thereby preventing the tailgate 4 from falling freely.

In still other embodiments, the electronic controller 140 can be configured to detect if the tailgate 4 is coupled or secured to the power tailgate system and/or the vehicle 1. In particular, the electronic controller 140 can include a tailgate detection routine that identifies whether the tailgate 4 is coupled or attached to the box 8 of the truck 1. When the tailgate 4 is removed from the box 8 of the truck 1, the tailgate detection routine powers down or shuts off the power tailgate system such that the strut 12 and actuator arm assembly 68 are maintained in the open position of the tailgate 4. Accordingly, when the tailgate 4 is reinstalled in the box 8 of the truck 1, the strut 12 and actuator arm assembly 68 are ready to power the tailgate 4 closed.

Figure 20:
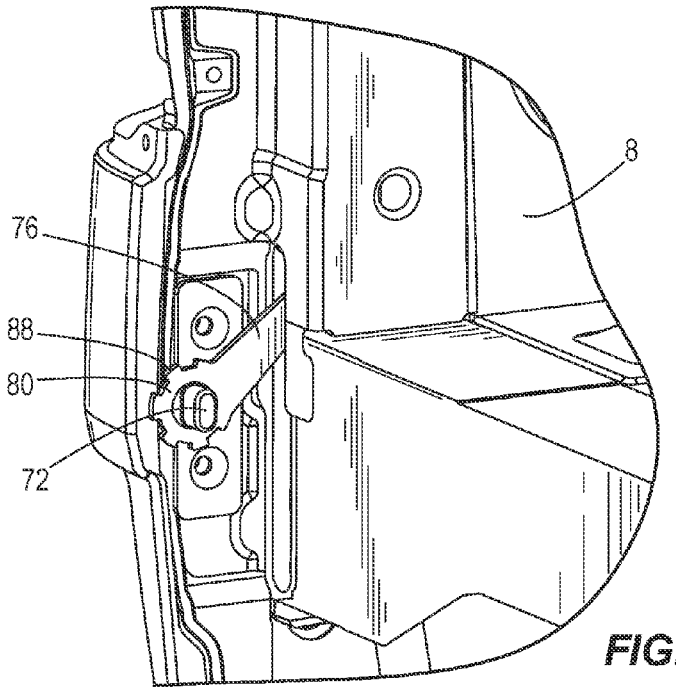
FIG. 20 is another partial perspective view of the power tailgate system of FIG. 1, showing the actuator arm assembly when the tailgate is in an open position.

In operation of the powered tailgate system, the tailgate 4 is moved from the closed position to the open position when the electronic controller 140 receives the open tailgate signal. Particularly, the electronic controller 140 electrically communicates with the strut 12 to cause actuation of the strut 12, which in turn, causes the drive arm 76, including the second end 84 of the drive arm 76, to pivot towards the proximal endfitting 24 of the strut 12 (FIG. 20). As such, the tailgate 4 is powered open because the collar 120 of the coupler assembly 92 is locked in the second position. Once the tailgate 4 is in the open position, the collar 120 of the coupler assembly 92 can be slide to the first position (i.e., the lever 116 is engaged with the distal slot 133 of the collar 120) if the user desires to remove the tailgate 4 from the box 8 of the truck 1. Accordingly, the coupler assembly 92 of the power tailgate system provides for quick disconnection and connection of the tailgate 4 to the box 8 of the truck 1 as compared to a conventional tailgate, which requires the user to supply tools and time to remove such a conventional tailgate from its respective truck.

Figure 19:
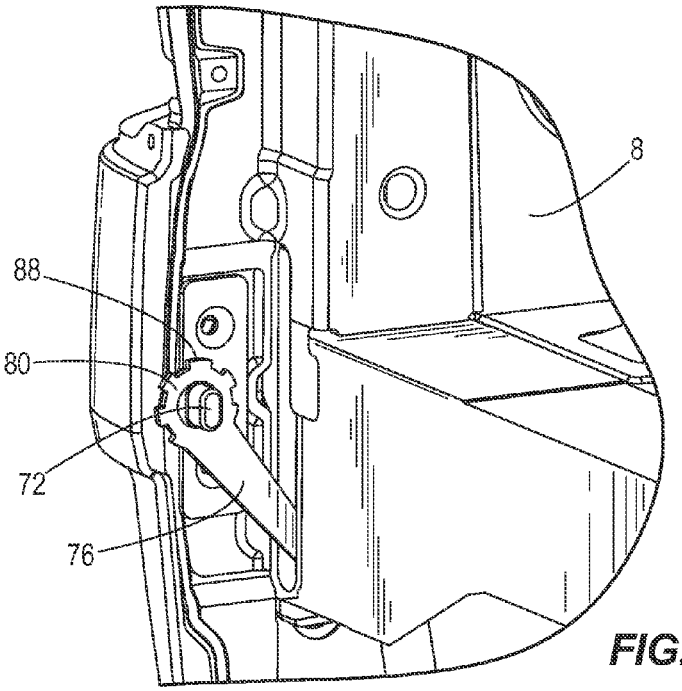
FIG. 19 is a partial perspective view of the power tailgate system of FIG. 1, showing the actuator arm assembly when the tailgate is in a closed position.

When the electronic controller 140 receives the close tailgate signal, the electronic controller 140 electrically communicates with the strut 12 to cause actuation of the strut 12, which in turn, causes the drive arm 76, including the second end 84 of the drive arm 76, to pivot away from the proximal endfitting 24 of the strut 12, thereby powering the tailgate 4 closed (FIG. 19). Additionally, the tailgate 4 can be opened and closed manually by the user if desired or during a loss of power. In some embodiments, the falling tailgate routine can detect that the tailgate 4 is being opened even when the open tailgate signal has not been received by the electronic controller 140, and control descent of the tailgate 4 to prevent the tailgate 4 from falling freely and injuring the user.

In other embodiments, the electronic controller 140 can use the latching routine to determine if the tailgate 4 is latched and if so, powers unlatching of the tailgate 4 from the box 8 of the truck 1 before powering the tailgate 4 open. The electronic controller 140 can also use the latching routine to determine if the tailgate 4 is latched after the tailgate 4 is powered close, and if not, power latching of the tailgate 4 to the box 8 of the truck 1. The electronic controller 140 may further use the latching routine to determine if the tailgate 4 is latched after the tailgate 4 is manually closed, and if not, power latching of the tailgate 4 to the box 8 of the truck 1.

In still other embodiments, the electronic controller 140 can employ the tailgate detection routine to determine if the tailgate 4 is coupled to the box 8 of the truck 1, and if not, the tailgate detection routine shuts off the power tailgate system. When the tailgate 4 is attached to the box 8 of the truck 1, the tailgate detection routine detects the presence of the tailgate 4, and then activates the power tailgate system, allowing the tailgate 4 to be powered between the open and closed positions.

Although the invention has been described in detail with reference to certain preferred embodiments, variations and modifications exist within the scope and spirit of one or more independent aspects of the invention as described.

What is claimed is:

1. A power tailgate system for a vehicle comprising:

an actuator for moving a tailgate of the vehicle between an open position and a closed position;

a spring spaced apart from the actuator for counter-balancing a weight of the tailgate; and a coupler assembly having a collar movable relative to the tailgate along an axis of rotation of the tailgate, the collar movable axially along the axis of rotation between a locked position and an unlocked position, wherein in the locked position, the actuator is secured to the tailgate, and wherein in the unlocked position, the tailgate is removable from the vehicle and the actuator.

2. The power tailgate system of claim 1, further comprising an actuator arm assembly having a pin defining the axis of rotation and an arm having a first end rotatable about the pin.

3. The power tailgate system of claim 2, wherein the actuator is configured to rotate the first end of the arm about the pin, thereby moving the tailgate of the vehicle between the open position and the closed position.

4. The power tailgate system of claim 2, wherein the actuator has a proximal end fitting attached to the vehicle and a distal end fitting coupled to a second end of the arm of the actuator arm assembly.

5. The power tailgate system of claim 4, wherein the second end of the arm of the actuator arm assembly pivots towards the proximal end fitting of the actuator when the tailgate moves to the open position.

6. The power tailgate system of claim 4, wherein the second end of the arm of the actuator arm assembly pivots away from the proximal end fitting of the actuator when the tailgate moves to the closed position.

7. The power tailgate system of claim 2, wherein the coupler assembly includes a body fixed to the tailgate and having a slot for receiving the pin of the actuator arm assembly.

8. The power tailgate system of claim 1, wherein the collar has a slot and wherein the coupler assembly further includes a lever engagable with the slot of the collar.

9. The power tailgate system of claim 8, wherein in the first position, the lever engages the slot of the collar, thereby permitting removal of the tailgate from the vehicle.

10. The power tailgate system of claim 2, wherein the first end of the arm includes teeth and wherein the teeth are engagable with notches of the collar when the collar is in the second position, thereby preventing removal of the tailgate from the vehicle.

11. The power tailgate system of claim 1, further comprising an electronic controller in electrical communication with the actuator and configured to receive a signal for opening the tailgate or a signal for closing the tailgate.

12. The power tailgate system of claim 11, wherein the electronic controller receives the signals for opening and closing the tailgate from a fob.

13. The power tailgate system of claim 11, wherein the electronic controller is configured to detect if the tailgate is coupled to the power tailgate system.

14. A coupler assembly for removably attaching a tailgate to a vehicle comprising:

a body fixed to the tailgate and having a slot for receiving a portion of the vehicle;

a collar positioned about the body and movable axially between a first position permitting removal of the tailgate from the vehicle and a second position preventing removal of the tailgate from the vehicle.

15. The coupler assembly of claim 14, further comprising a lever and wherein the collar includes a slot engagable with the lever when the collar is located in the first position.

16. The coupler assembly of claim 15, wherein the lever is movable, thereby allowing the collar to move between the first position and the second position.

17. The coupler assembly of claim 16, wherein the lever is movable by a spring.

18. The coupler assembly of claim 14, wherein the slot of the body receives the portion of the vehicle when the collar is located in the second position.

19. The coupler assembly of claim 14, wherein the collar includes notches for receiving a second portion of the vehicle when the collar is located in the second position.

* * * * *